United States Patent [19]

Eickmann

[11] Patent Number: 4,628,794

[45] Date of Patent: Dec. 16, 1986

[54] CONTROL-PINTLE FOR FLUID FLOW DEVICES

[76] Inventor: Karl Eickmann, 2420 Isshiki, Hayama-machi, Kanagawa-ken, Japan

[21] Appl. No.: 705,756

[22] Filed: Feb. 25, 1985

Related U.S. Application Data

[60] Continuation of Ser. No. 421,677, Sep. 22, 1982, abandoned, which is a division of Ser. No. 109,577, Jan. 4, 1980, abandoned, which is a continuation-in-part of Ser. No. 910,809, May 30, 1978, abandoned.

[51] Int. Cl.[4] ..... F01B 13/06

[52] U.S. Cl. ..... 91/498

[58] Field of Search ..... 91/498, 491, 492

[56] References Cited

U.S. PATENT DOCUMENTS

| | | | |
|---|---|---|---|
| 2,328,717 | 9/1943 | Glasner | 91/492 |
| 3,874,272 | 4/1975 | Bosch | 91/498 |
| 3,875,852 | 4/1975 | Bosch | 91/498 |
| 3,893,376 | 7/1975 | Nonnenmacher | 91/498 |
| 4,131,056 | 12/1978 | Rockwell | 91/498 |

FOREIGN PATENT DOCUMENTS

| | | | |
|---|---|---|---|
| 422703 | 12/1925 | Fed. Rep. of Germany | 91/205 |
| 1068079 | 10/1959 | Fed. Rep. of Germany | 91/498 |
| 2038935 | 7/1980 | United Kingdom | 91/498 |

*Primary Examiner*—William L. Freeh

[57] ABSTRACT

A control pintle carries a rotor which rotates around the pintle. The rotor has chambers which can take in and expel fluid. Passages of a reduced cross-sectional area carry the fluid to or from the control pintle and to or from the chambers. The control pintle has control parts and fluid lines, as well as certain recesses. Rotor and control pintle are insofar known from the former art. The invention provides unloading recesses in specific relation to the passages and chambers to make the rotor float around the control pintle concentrically or eccentrically in a desired extent. Supply slots are added to assist the build-up of hydrodynamic pressure fields to act in co-operation with the hydrostatic forces. Details are shown, how such supply means become provided or supply be secured.

1 Claim, 11 Drawing Figures

FORMER ART

CONTROL-PINTLE FOR FLUID FLOW DEVICES

REFERENCE TO RELATED APPLICATION

This is a continuation of my earlier application Ser. No. 06-421,677, now abandoned, filed on 09/22/82 as a divisional application of my earlier patent application Ser. No. 109,577, which was filed on Jan. 4 th, 1980 and was a continuation in part application of my earlier application serial number 910,809, which is now abandoned. Application Ser. No. 910,809 filed 5/30/78 was abandoned after the filing of the application Ser. No. 109,577 and application Ser. No. 06-109,577 is now abandoned.

BACKGROUND OF THE INVENTION

My earlier patent application Ser. No. 910,809 filed 5/30/78 discloses unloading recesses on a control body or control pintle, which carries a rotor. The teaching and aim of the said application is, to force the rotor to float eccentrically relatively to the axis of the control pintle in order to bring the inner face of the rotor closer to the outer face of the control pintle in the high-pressure zone adjacent the high pressure control port.

The present invention now discovers, that similar means can be utilized to make the rotor float either centrically, eccentrically or float with a pre-determined limted eccentricity around the control pintle, when the unloading recesses are respectively located. Means to supply pressure fluid to actuate hydrodynamic pressure fields at partially eccentric or eccentric rotation of the rotor can be added.

The invention thereby obtains reduced leakage or reduced friction and makes it possible to obtain any desired centric, eccentric or partial eccentric running of the rotor relatively to the control-pintle.

FIELD OF THE INVENTION

The invention relates to fluid flow machines, wherein fluid flows through a control pintle into or out of working chambers in a rotor of such machine. The invention relates only to those of the above mentioned machines, which have substantially radially directed passage means to the respective chamber and wherein the cross-sectional area through the passage means is less than the cross-sectional area through the respective chamber, so, that a radial inwardly towards the control pintle directed force appears in the respective chamber of the rotor due to the fact, that a bottom is appearing in the chamber which is subjected to the pressure in the fluid in the chamber.

The machine may act as a compressor, pump, motor, engine or transmission.

DESCRIPTION OF THE PRIOR ART

My elder U.S. Pat No. 3,223,046 of Dec. 14 th, 1965 shows a radial piston fluid flow machine, which has a control pintle which carries thereon a floating rotor. The cylinders are provided with passages towards the control pintle and the passages already have a smaller cross-section than the cylinders, whereby the mentioned bottom appears in the cylinders and provides a force onto the rotor, directed towards the control pintle.

The newer U.S. Pat. No. 3,866,517 of Mr. Aldinger of Bosch of Feb. 18 th, 1975 shows a similar machine as that of my elder U.S. Pat. No. 3,223,046 but with the addition of recesses which shall load themselfes through the clearance between the rotor and the control body with a medial pressure. This patent provides the must of communication passages to send the pressure from the mentioned recesses to recesses on the diametric opposite portion of the control pintle. The Aldinger U.S. Pat. No. 3,866,517 fails to mention the known elder of my U.S. Pat. No. 3,223,046 as related former art.

SUMMARY OF THE INVENTION

This invention discovers the following difficulties and drawbacks of the former art:

(a) U.S. Pat. No. 3,223,046 fails to set unloading recesses, whereby the hydrostatic pressure fields and the hydrodynamic pressure field around the control pintle are not separated from each other. That led to welding between control pintle and rotor after 3 to 5 years of operation of the machine.

(b) U.S. Pat. No. 3,866,517 partially fails to obtain its aims, because it forces by its arrangement the occurance of at least six leakage flows axially along the surface of the control pintle. The efficiency of the machine is thereby drastically reduced and the device can not obtain a maximum of power and efficiency.

(c) Patents, related to U.S. Pat. No. 3,866,517 are particularly even adapted to more than six leakage flows, for example; DOS No. 2,433,090; U.S. Pat. No. 3,810,418; or U.S. Pat. No. 3,875,852; while U.S. Pat. No. 3,893,376 produces increased leakage by too short sealing lands.

The intention and aims and objects of the present invention, are, to reduce the drawbacks of the former art, which the present invention discovered in the former art and, especially to restrict the leakage flows in the device to a maximum of two major leakage flows. Separatedly provided hydrodynamic pressure fields may act to centre the rotor relatively to the control pintle in a desired and pre-determined extent.

The invention obtains its aims by providing a pair of unloading recesses beyond sealing lands of the high-pressure control port to co-operate with the pressure forces in the working chamber which are directed towards the control body.

Separated from the mentioned unloading recesses there may be provisions to supply a fluid pressure into a specific location or locations to build up hydrodynamic pressure fluid fields to carry the rotor in a pre-determined relationship relatively to the axis of the control pintle.

The invention also deals with the specific arrangements of supply slots, which act to supply respective fluid or fluid under specific pressure into the desired hydrodynamic bearing fields. While such hydrodynamic bearing fields might occasionally draw fluid into the respective clearance by suction pressure in such a clearance, the invention recognizes, that such a suction pressure is often too low or unsatisfactory to secure a proper loading of the hydrodynamic bearing field clearance or adjacent faces with a proper supply of fluid.

Consequently, the invention also deals with and provides means for the proper supply of fluid into the respective supply slots of the invention. In specific arrangements of the invention, such means consist of specific grooves, passages, recesses or communications towards the respective supply slots.

CONCISE DESCRIPTION OF THE EMBODIMENTS

The embodiments of the invention may in a concise form be described as follows:

(A) Control pintle in fluid flow devices which bears on the outer face of the control pintle a rotor which has working chambers and passages of a restricted cross-sectional area relative to the working chambers, while the control pintle includes channels and ports wherethrough the fluid flows in alternating alignement with the passages of the rotor, wherein pressure in fluid in the chambers of the rotor produces a force onto the bottom portion of the respective chamber directed toward the control pintle and wherein recesses are provided in the outer face of the control pintle to divide the outer face of the control pintle into different areas, as utilized in the former art;

wherein a pair of unloading recesses is provided on the outer face of the control body and communicated to unloading passages which port into a space under substantially low pressure; while sealing lands are provided between the high pressure port of the control body and the said pair of unloading recesses, whereby one of said unloading recesses is axially distanced from the said control port in one axial direction and the other unloading recess of said pair of unloading recesses is distanced from said control port in the other axial direction parallel to the axis of said control pintle;

wherein the forces of fluid in the clearance between said outer face and the inner face of said rotor and between said control port and said unloading recesses act in a direction towards the said inner face of said rotor contrary and oppositionally to said force onto said bottom portion of said respective chamber and thereby maintain a desired distance of the said outer face from the said inner face at the high-pressure zone of said control pintle and said rotor;

wherein said control pintle forms supply slots in a pair of bearing face portions and fluid supply passages are provided from a space under at least medial pressure to said pair of bearing face portions to create on said bearing face portions partially hydrodynamic pressure fields between said inner face and said outer face, when said rotor revolves slightly eccentric relatively to the axis of said control pintle;

wherein said unloading recesses are peripherically extended substantially parallel to said port and the supply slots extend in a direction perpendicular to said unloading recesses and substantially parallel to the axis of said control pintle, while said slots are also extending through said outer face into said control pintle.

Or, as:

(B) The device of (A), wherein said supply passages are communicated to the control arc portion of said control pintle between a high-pressure and a low-pressure port of said control pintle, wherein said closing arch is extended in the direction of rotation of said rotor to build up a pre-compression of the fluid in the respective chamber of said rotor; and wherein said supply passages temporary communicate with a respective passage of said passages of said rotor when said passage of said passages revolves over said supply passages and when said passage of said passages of said rotor contains said pre-compression of said fluid.

Or, as:

(C) The device of (A), wherein said fluid supply passages are communicated to a space under high pressure, for example to a respective high pressure fluid line through said control pintle.

Or, as:

(D) the device of (A), wherein a supply passage is provided as a substantially axially extending groove along the top of the control pintle through the closing arch of the control pintle to extend into the respective supply slots for leading the respective pressure of the respective passage to the respective chamber of said working chambers into said respective supply slots.

BRIEF DESCRIPTION OF THE DRAWINGS

FIG. 7 demonstrates, while it is partially demonstrating the cross-sections through FIG. 6, an other embodiment of communication.

DESCRIPTION OF THE PREFERRED EMBODIMENTS

Figures 1, 2, 3, 4, 5, 6, 7, 8, 9, 10, 11:
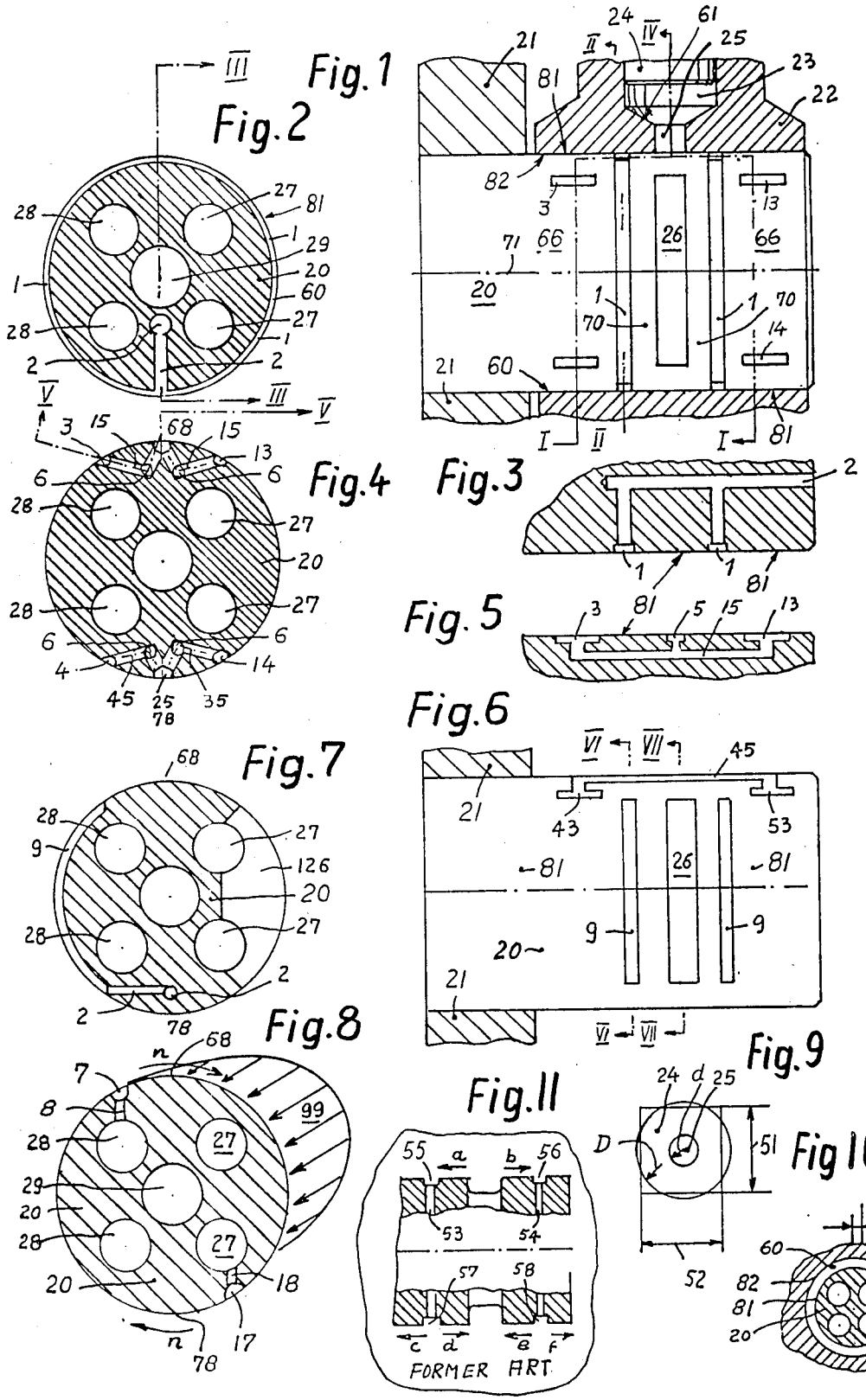
FIG. 1 is a longitudinal sectional view through one embodiment of the invention, wherein the control pintle is seen in a view onto it.
FIG. 2 is a cross-sectional view through FIG. 1 along the line II—II.
FIG. 3 is a sectional view through a portion of FIG. 2 along a portion of the line III—III.
FIG. 4 is a cross-sectional view through FIG. 1 along line I—IV, but demonstrates a modified embodiment of passages.
FIG. 5 is a sectional view through FIG. 4 along line V—V.
FIG. 6 is a view onto another embodiment of a control pintle of the invention.
FIG. 7 is in its left and right portions a cross-sectional view through FIG. 6 partially along lines VI—VI and VII—VII respectively.
FIG. 9 is a schematic, explaining the actions of forces, related.
FIG. 10 demonstrates the control clearance in an enlarged scale.
FIG. 11 demonstrates in a schematic the pluralities of leakage flows of the former art, which the invention reduces to a single pair of leakage flows.
FIG. 8 is a cross-sectional view through FIG. 1 or 6 along the lines VI—VI or I—IV, but demonstrates an alternative of communication and the probable development of a sample of a hydrodynamic pressure field.

Control body or control pintle 20 is fastened in the housing portion 21 of the device. The control pintle has a cylindrical outer face 81 which bears thereon the rotor 22 of the machine. Rotor 22 contains a plurality of working chambers 23 wherein displacement means, for example pistons 24, may reciprocate. The control pintle 20 has channels 28 ending in control port 26 and channels 27 ending in control port 126. Control port 126 is diametrically located on pintle 20 relatively to port 26. The channels 27 and 28 pass fluid into or out of the ports 26 or 126. The rotor 3 has an inner face 82 which forms around the outer face 81 of control pintle 20 the control clearance 60 as known in the art.

From the inner face 82 lead rotor passages 25 to the respective chambers 23. The cross-sectional area through the passages 25 is considerably smaller than the cross-sectional area through the chambers 23, whereby a bottom 61 is formed in each chamber 23. The cross-sectional area of the bottom 61 is cross-sectional area through chamber 23 minus the cross-sectional area through passage 25. In most practical applications each chamber has one single individual passage 25 but there could be more such passages to the respective chamber 23. The rotor 22 has at least one chamber 23, but commonly a plurality of chambers, mostly an uneven number of chambers, for example, 5, 7, 9 or 11 chambers 23. Chambers 23 may be of rectangle or any other configuration. They may extend axially, radially or in a direction therebetween. They may be radial piston cylinders, axial piston cylinder's, vane-boardered chambers of vane devices, chambers of gear, internal gear or trochoid gear pumps or motors.

The invention belongs however only to those chambers in rotors, which form a bottom 61 by a passage of smaller cross-sectional area than the cross sectional area through the respective chamber 23.

Fluid may flow through the channels of the control pintle 20 and ports 26 or 126 of pintle 20 and through passages 25 into or out of chambers 23, or fluid is kept stationary in chambers 23 by communication with ports 26, 126 and channels 27, 28 of pintle 20.

When pressure acts in a respective chamber 23, a force is build up or maintained under said pressure in chamber 23 and directed against the bottom 61 and thereby directed towards the control pintle 20. Since at the presence of such pressure in fluid in chamber 23 the pressure acts in all directions and since passage 25 is communicated to the respective port 26 or 126 and to clearance 60 between the inner face 82 of rotor 22 and outer face 81 of pintle 20, the pressure in fluid of the respective chamber 23 also moves into the clearance 60 in the neighborhood of the respective passage 25. Or also into the respective port 26 or 126.

A sealing land is present adjacent the ports and passages 26, 126, 25 and is shown by referential numbers 70. Sealing lands 70 extend axially along the outer face 81 towards the unloading recesses 1, which are provided through the face 81 into the control pintle 20.

The fluid which enters the clearance 60 or which is present there, experiences a drop in pressure along the clearance in the direction toward the respective recesses, for example 1 or 9. The pressure gradient may obtain a mean value of 0.4 to 0.6 of the pressure difference in passages 25 and in recesses 1 to 9 and for first calculations a medial pressure of 0.5 of said values may be assumed. An accurate value can be obtained by experimential testing, because it depends on temperatures, relative speeds etc.

When the passages 25 are bores and chambers 23 are radial cylinders, the schematic of FIG. 9 applies. The bottom 61 has then the area $(D^2-d^2)$ pi/4.

The associated area of the clearance where the pressure with 0.5 value acts, is then 51×52, as shown in FIG. 9.

The pressure gradient in the respective portion of clearance 60, defined by 51×52 in FIG. 9 provides a force in the direction against the respective portion of the inner face 82 and thereby in a direction contrary and oppositionally directed relatively to the force out of chamber 23 against bottom 61.

Thus, there is a force, which presses the rotor 22 towards the control port 26 or 126 or away from it of the size:

$$\text{Delta } F=[(D^2-d^2)\text{pi}/4]P-0.5(M\times N)P. \quad (1)$$

wherein "M" stands for referential 51, "N" stands for referential 52 of FIG. 9; 0.5 is the pressure gradient in the clearance, namely the meanvalue thereof and may varify from 0.4 to 0.6 roughly. And, wherein "P" is the pressure in the fluid in chamber 23, passage 25 and port and channels 26, 126, 27 or 28 respectively.

So far the arrangement is principially known from the former art and also from my parental application.

The invention now discovers, that equation 1 can be utilized not only to let the rotor float centrically relatively to the axis 71 of control pintle 20, but also in any other desired position, for example, eccentrically or part-eccentrically.

Especially, when additional hydrodynamic pressure fields are artificially created to act in unision with equation 1.

It is therefore possible, in accordance with this invention, to reduce either the leakage or the friction in clearance 60 at will.

To obtain this aim, the invention provides:

In FIGS. 1 and 2 the unloading annular grooves or unloading recesses 1 and communicates them by passage(s) 2 to a space under no or low pressure. When so required, passage(s) 2 and recess 1 can also be communicated for example via a valve or directly to the respective low-pressure port 26 or 126. FIG. 3 demonstrates the communication of unloading recesses 1 to the interior of the pump which will be under no pressure at this situation.

In FIG. 6 the annular grooves 1 are replaced by unloading recesses 9 of a restricted length substantially equal to the length of the respective port 26 or 126 and preferred to be parallel to said port 26 or 126. The passage(s) 2 is set similar to that of FIGS. 1, 2, 3.

The pressure in recess(es) 1 is thereby very low or zero.

The feature of this arrangement of the invention is, that only two flows of leakage take place out of the respective high-pressure control port 26 or 126, namely flows "a" and "b" of FIG. 11.

On the contrary thereto in the former art the passages 53 send a medial pressure also into the opposite recesses 57 and 58. Thus, there are appearing six flows of leakage in the former art of U.S. Pat. No. 3,866,517, namely a,b,c,d,e, and f, namely flows a and b from the control port to the medial pressure passages 55 and 56 and flows c,d,e and f from the medial pressure passages 57 and 58 respectively to the low pressure or no pressure area(s) of the device.

Agreed, the pressure in these six flows is only half of that of the invention, and the leakage in each of the flows is only half of that of flows a and b of the invention, but two times one gives only 2, while six times one half gives three. Thus, the leakage is reduced at least by ⅓ relative to the former art device by this invention.

According to the figures, the invention provides additional bearing portions 66 on the control body. These are located preferredly endwards of the unloading recesses 1 or 9 and form end portions of the outer face 81 of control body 20.

The invention now makes it possible, in addition to the proper dimensioning of the geometric values of equation 1, to create hydrodynamic pressure fields, for example, those of FIG. 8, shown by referential number 99.

To obtain this respective pressure field 99 of hydrodynamic action, a fluid pressure supply passage 45 or 5,6,15,35 or 8 extends from a space under pressure into the respective bearing portion 66 and supplies or maintains fluid in the area of clearance 60 over the mentioned bearing portions 66.

The supply passages port into slots 3,4,43 or 53, which extend in bearing face portions 66 in a direction parallel to the direction of axis 71 of control pintle 20, perpendicular to unloading recesses 1.

The mentioned fluid pressure supply passages may extend from the closing arc or from a space under high pressure. A number of samples of application of the supply passages are therefore shown in different figures of the drawing. For example:

In FIG. 8 the supply passage 8 connects supply slots 7 with either one of the channels 27 or 28 of pintle 20. By this arrangement the device is reversible; meaning that at one direction of flow slot 17 is communicated by supply passage 18 to high pressure channel 27 and at the other direction of flow the slot 7 is connected by supply passage 8 to high pressure channel 28 of control pintle 20. FIG. 8 also illustrates, that it is suitable to provide supply slots 7 or 17 or also 3,13,43,53 in an angle before the control arc 68 or 78. This angle is found from FIGS. 4 and 8 to be about 15 to 30 degrees before the respective closing arch. The respective closing archs are the areas around referential numerals 68 and 78 of FIGS. 4 and 7. Because, when the rotor 22 revolves in the direction of arrow "n" the distance of the slots 7,17 etc. has an influence on the rightward extension of the hydrodynamic pressure field 99 in the direction of rotation n of rotor 22.

In order to create the hydrodynamic pressure field 99 it is required, that the rotor 22 floats a little eccentrically, as shown by eccentricity "E" in FIG. 10 in an enlarged scale, relative to control pintle 20 because the clearance 60 must reduce in distance between inner face 82 and outer face 81 in the direction "n" of rotor 22 towards the middle of the right side of FIG. 8, since otherwise no hydrodynamic pressure field 99 can build up.

FIGS. 4,5 and 6 show the communication of the control arch 68 or 78 by supply passage(s) 5,15,6,45 and thereby of the respective passage 35 to the respective supply slot 3,13,4,14,43, 53 of pintle 20.

When this communication is provided, the control arch 68 or 78 respectively must be extending in the rotary direction "n" of rotor 22 in order, that the chambers 23 build up a pre-compression pressure, when their respective passages 25 revolve over the respective control arch 68 or 78; or gradually to reduce the pressure, when the respective passages 25 revolves from a high pressure port 26 or 126 over the respective closing control arch 68 or 78 towards a respective low pressure control port 26 or 126.

The communication to the control arch has the additional feature, that the pressure in the respective chamber 23 builds up or reduces over a larger angle "alpha" of rotation of the rotor. That reduces noise in the machine. In addition, the supply fluid is not taken out from the high pressure area but from a medial pressure area and therefore the power used to build up the fluid supply into the respective hydrodynamic bearing face portion is less, than when the communication of FIG. 8 is used.

The invention further obtains the following action and result, when so desired:

The centric floating of the rotor 22 around pintle 20 brings a leakage, similar to that described. The fully eccentric floating of the rotor 22 around control pintle 20 leads to a close running of inner face 82 along outer face face 81 at least in one line and the neighborhood thereof, whereby the leakage reduces, but the friction considerably increases. Thus, the full eccentric floating is also not the final or best solution.

The invention is now able to dimension the relations of FIG. 9 and the areas of bearing face portions 66 to produce hydrodynamic pressure fields 99 to such desired perfection, that the hydrodynamic field 99 defines in combination with the matters of FIG. 9 a certain eccentricity "e" between faces 81 and 82 of FIG. 10, where the sum of the losses of friction and leakage in the control clearance 60 becomes a minimum. The invention thereby obtaines a considerable increase of efficiency and power of the respective device.

The details of the invention may be applied single or in combination, depending on cost or desire to perfectness of the device.

I claim:

1. Control pintle in fluid flow devices which bear on the outer face of the control pintle a rotor which has working chambers and passages of a restricted cross-sectional area relative to the working chambers, while the control pintle includes channels and ports wherethrough the fluid flows in alternating alignement with the passages of the rotor, wherein pressure in fluid in the chambers of the rotor produces a force onto the bottom portion of the respective chamber directed toward the control pintle and wherein recesses are provided in the outer face of the control pintle to divide the outer face of the control pintle into different areas, as utilized in the former art;

wherein a pair of unloading recesses is provided on the outer face of the control body and communicated to unloading passages which port into a space under substantially low pressure, while sealing lands are provided between a high pressure port of the control body and the said pair of unloading recesses, whereby one of said unloading recesses is axially distanced from the said control port in one axial direction and the other unloading recess of said pair of unloading recesses is distanced from said control port in the other axial direction parallel to the axis of said control pintle;

wherein the forces of fluid in the clearance between said outer face and the inner face of said rotor and between said control port and said unloading recesses act in a direction towards the said inner face of said rotor contrary and oppositionally to said force onto said bottom portion of said respective chamber, to thereby maintain a desired distance of the said outer face from the said inner face at the high-pressure zone of said control pintle and said rotor;

wherein said control pintle forms axially endwardly of said unloading recesses a pair of bearing face portions with axially extending fluid supply slots therein, while fluid supply passages are provided from a space under at least medial pressure to said supply slots in said pair of bearing face portions to create on said bearing face portions partially hydrodynamic pressure fields between said inner face and said outer face, when said rotor revolves slightly eccentric relative to the axis of said control pintle, while said unloading recesses peripherically extend substantially parallel to said port(s) and said supply slots extend in a direction perpendicular to said unloading recesses and substantially parallel to the axis of said control pintle with said slots extending through said outer face into said control pintle with the axial ends of said slots closed by the axial remainders of said bearing face portions, and, wherein a supply passage is provided as a substantially axially extending groove along the top of the control pintle through the closing arch of the control pintle to extend into the respective supply slots for leading the respective pressure of the respective passage to the respective chamber of said working chambers into said respective supply slots.

* * * * *